United States Patent [19]

Klaber

[11] 4,317,638

[45] Mar. 2, 1982

[54] FOLDABLE PEN KEY RING

[76] Inventor: Michael C. Klaber, 10526 Caminito Obra, San Diego, Calif. 92126

[21] Appl. No.: 114,095

[22] Filed: Jan. 21, 1980

Related U.S. Application Data

[63] Continuation-in-part of Ser. No. 966,892, Dec. 6, 1978, abandoned.

[51] Int. Cl.[1] ..... B43K 29/00; B43K 29/12

[52] U.S. Cl. ..... 401/195; 40/2 A; 70/456 R; 70/457; 70/458; 70/459; 401/52

[58] Field of Search ..... 401/195, 29, 99, 52; 40/2 A, 330; 70/456 R, 457, 458, 459

[56] References Cited

U.S. PATENT DOCUMENTS

| | | | |
|---|---|---|---|
| 785,899 | 3/1905 | Brandt | 40/2 A |
| 825,184 | 7/1906 | Brandt | 40/2 A X |
| 1,078,733 | 11/1913 | Kohn | 70/457 |
| 1,183,812 | 5/1916 | Gillespie | 70/457 |
| 1,795,555 | 3/1931 | Greenwood | 40/2 A X |
| 2,069,317 | 2/1937 | Lipic, Jr. | 70/456 R |
| 2,218,199 | 10/1940 | Hauton | 70/456 R |
| 2,554,303 | 5/1951 | Longhenrich | 70/457 X |
| 2,896,576 | 7/1959 | Baer | 401/195 |
| 4,081,217 | 3/1978 | Klaber | 401/195 X |

*Primary Examiner*—Steven A. Bratlie
*Attorney, Agent, or Firm*—Henri J. A. Charmasson

[57] ABSTRACT

A foldable pen pivotally connected to a tray, said tray having a projecting arm defining an opening between said tray and projecting arm to form a carrying loop, the projecting arm further containing a mortise dimensioned to receive the writing nib of the foldable pen in the closed position. Detents proximal to the pivotal connection lock the assembly in either open or closed positions.

4 Claims, 9 Drawing Figures

FOLDABLE PEN KEY RING

PRIOR APPLICATION

This application is a continuation-in-part of an application bearing Ser. No. 966,892 filed Dec. 6, 1978, now abandoned, copending with this application, for a Foldable Pen. The inventor is Michael C. Klaber and the application is assigned to Group Art Unit 337.

TECHNICAL FIELD

The invention is in the field of foldable tools and more particularly a foldable pen in combination with a tray and carrying loop, the pen being pivotally engaged and lockable in the open or closed position by detent means. Foldable pens are known in the prior art such as my U.S. Pat. No. 4,081,217.

SUMMARY OF THE INVENTION

Although foldable pens are known in the prior art, the present invention provides a novel combination of elements which cooperate to achieve an unprecedented assembly. These features are embodied in a flattened, elongated body or tray which progressively flares to terminate at its widest portion in an arm-like structure defining a loop. The arm-like structure is integral with one end of the tray, but is left with a slight restriction or opening at the other end. The arm can be displaced from side to side by applying pressure for purposes of inserting a key ring or the like. The arm returns to its original position and, even though a small opening or restriction remains, the key ring will not dislodge from the loop. This feature has been incorporated to obviate disengagement of the key ring and loop when the foldable pen is in the open position, a decided advantage over the prior art. Yet another advantage is realized in the larger area of the tray itself which allows for facile and steady grasping of the pen in the unfolded or functional position. In the closed or inert position, the nib of the pin fits into a mortise in the arm-like structure, completely closing the aforementioned restriction and preventing contact of the nib with objects such as clothing, etc. The assembly, in the folded or closed position, thus provides a convenient device which embraces multiple functions. The tray member itself can be utilized to bear advertising media. Its surface area is more than sufficient to include identifying data such as a hotel address, room number, telephone, etc. The overall size of the assembly mitigates its potential loss by the user as is often the case with keys and/or key rings of diminutive size. The flattened configuration of the device allows its comfortable placing in the pocket of the user. Locking of the elongated member containing the writing instrument is achieved by a plurality of detents which interlockingly engage protuberances on the tray into corresponding wells on the elongated member. These detents are so disposed as to provide bi-modal locking in the closed position (wherein the writing nib is nestled in the mortise of the arm-like structure), or in the extended or writing position. The elongated, pen-holding member is pivotally and fixedly mounted on a plastic rivet protruding from the tray. Changing of the writing instrument is achieved in a similar way as conventional writing instrument devices, i.e., a longitudinal cavity is provided which houses the writing instrument. The writing nib of the pen extends beyond the orifice of the cavity.

Yet another object of the invention is the simplicity of parts relative to manufacture. Ease of construction is also inherent in this device as it can easily be seen that a limited number of parts are involved. These and other objects will become apparent in view of the following description of the drawings and appended claims.

DETAILED DESCRIPTION OF THE DRAWINGS

Figure 1:
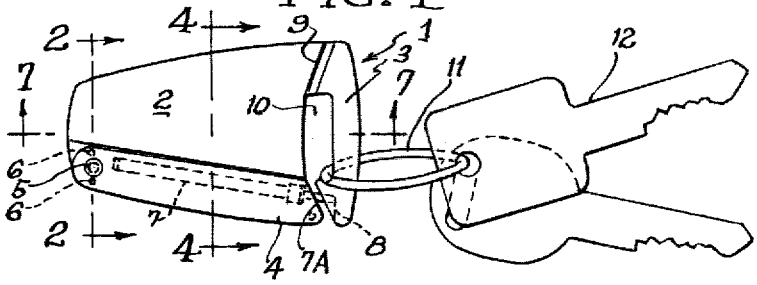
FIG. 1 is a side view of the foldable pen, tray and loop assembly shown with a key ring engaged around the loop.

Referring now to FIG. 1, a pen/keyholder device 1 is shown having tray member 2, arm-like projection 3, elongated member 4, rivet 5 and detents 6. A longitudinal cavity houses writing instrument 7 (shown in phantom), having nib 7A resting within mortise 8 of arm 3. Narrowing of the arm 3 is shown at 9. An opening 10 is formed by an edge of the tray 2 and arm 3. Key ring 11 is threaded around arm 3 and captures keys 12 therein.

Figure 2:
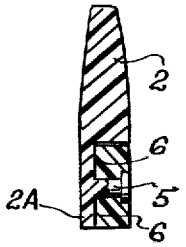
FIG. 2 is a cross section taken along line 2—2 of FIG. 1 illustrating pivotal connection, detent means, and relative thickness of the device.
Figure 3:
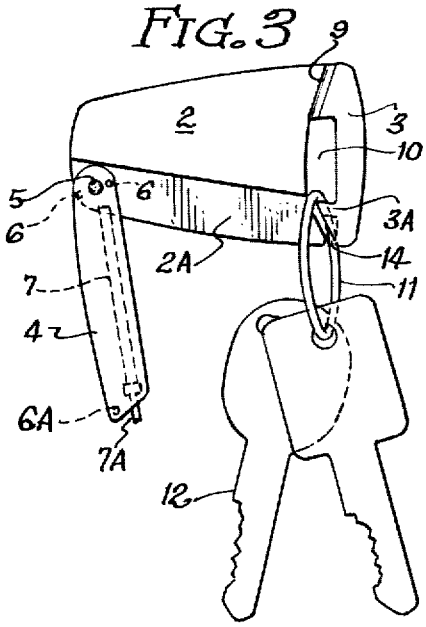
FIG. 3 is yet another side view of the device which shows the elongated pen-holding member in a unfolding position.

The cross section of FIG. 2 (taken along line 2—2 of FIG. 1) illustrates structural relationships in the narrow end of tray 2 which define protruding lip 2A bearing rivet 5 integral therewith. Detents 6 flank rivet 5 to provide locking engagement of elongated member 4 in either open or closed position. Pivotal engagement is accomplished by elongated member 4 pivoting about rivet 5. Also in this view relative dimensions of protruding lip 2A are exposed. As seen in FIG. 3, arm 3 is unattached to the tray on the side of nib 7A. A small channel-like opening 14 therefore lies between arm 3 (containing mortise 8) and an edge of lip 2A. In this view, key ring 11 is shown proximal to opening 10. Portion 3A of arm 3 can be sprung from side to side for insertion of a key ring past the narrow restriction or opening 14, yet opening 14 will not allow disengagement of the key ring 11 from the loop after returning to its normal, quiescent position. Detents 6 are disengaged in this position, i.e., they lock only in fully extended or closed positions. Structural narrowing 9 reduces integrity of the arm 3, thereby allowing flexibility at this juncture to spring open portion 3A of arm 3 when pressure is applied. Mortise 8, shown in phantom, is vacant of nib 7A and it is emphasized that absence of this component in the loop configuration will not effect disengagement of the key ring 11 from the loop.

Figure 4:
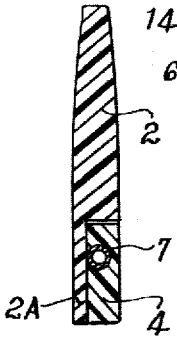
FIG. 4 is a cross section taken along line 4—4 of FIG. 1.

The cross section of FIG. 4, taken along line 4—4 of FIG. 1, depicts orientation of the writing instrument 7 within elongated member 4. Protruding lip 2A is clearly integral with tray member 2.

Figure 5:
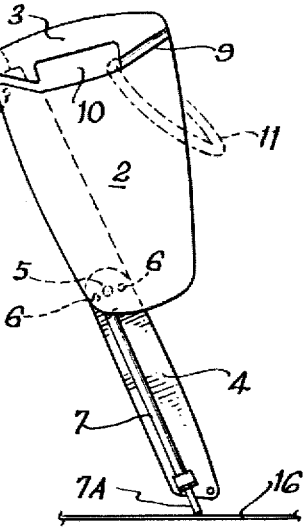
FIG. 5 is a side view of the device with the pen-holding member in open, locked position, and the writing nib of the pen impinging upon a surface.

FIG. 5 is an operational view of the elongated member 4 containing writing instrument 7 fully extended and in the locked position. Nib 7A is shown impinging upon a writing surface 16. Detents 6 are engagedly locked; detent 6A is disengaged. Rivet 5 and the rounded end of elongated member 4 are shown in phantom as this view is of the opposite face (of the view of FIG. 3) of the assembly.

Figure 6:
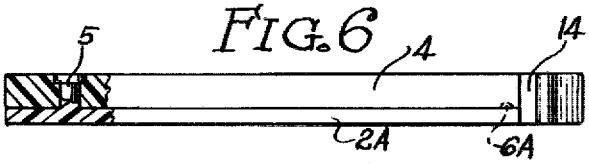
FIG. 6 is a bottom view of FIG. 1 taken along the edge bearing the foldable elongated member.
Figure 7:
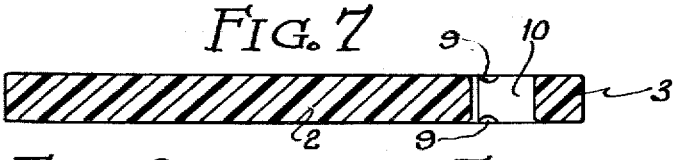
FIG. 7 is a section taken along line 7—7 of FIG. 1.
Figure 8:
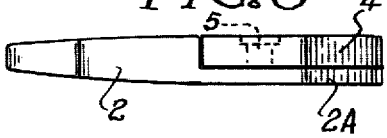
FIG. 8 is a side view detailing pivotal connection means.
Figure 9:
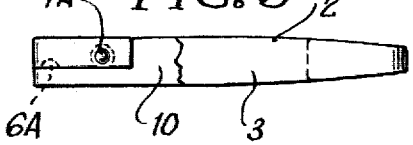
FIG. 9 is a partial cutaway of the right end of FIG. 6 detailing orientation of the ballpoint pen within the elongated member.

FIGS. 6, 7, 8 and 9 are included for purposes of structural layering orientation. In FIG. 6, rivet 5, protruding lip 2A, detent 6A and elongated member 4 are illustrated in cross section with elongated member 4 in the closed position. Detents 6 are not shown in this view because they are in a direct line with rivet 5 in this secured position. FIG. 7 (taken along line 7—7 of FIG. 1) is taken roughly parallel to elongated member 4 and clearly illustrates the opening 10 between arm 3 and tray 2. As more specifically illustrated in FIG. 8, rivet 5 is integral with protruding lip 2A and elongated member 4 abuts lip 2A and is pivotally connected at the rivet. The right end of FIG. 6 is shown in FIG. 9. Detent 6A lies proximal to nib 7A and locks elongated member 4 in this closed position.

The above embodiment is illustrative only and is not intended to restrict the invention to a form narrower than that lent by a fair interpretation of the claims appended below.

I claim:

1. A foldable tool usable as a key holding ring and message carrying tag which comprises:

a generally flat oblong body;

a ball point pen-holding elongated member, having first and second ends, which member in the folded position defines a first mode in which same is placed in stored position contiguously to a first side of said body;

means for pivotally connecting the first end of said member to a first corner of said body such that said member is pivotal between said first mode and a second mode in which said pen-holding member is extended from said body for use;

on the body, a projection extending in a generally arcuate direction from a second corner of the body diagonally opposite to said first corner, toward a third corner of the body adjacent to said first side;

said projection being shaped and dimensioned to leave a gap between it and a second side of the body joining said second and third corners;

means for restricting said gap to a narrow channel between the extremity of said projection and said third corner;

said channel being narrower than a key ring and said projection being sufficiently resilient to permit expansion of said channel by pressing a ring therethrough to snap said ring into or out of said gap; and means on said member comprising the tip of a pen held thereby for positively closing said channel when said member is in its first mode placed in the folded position alongside said body and including locking means between said body and said member comprising detents interlockingly engageable on said first end of said member and said body which hold the member in either open or closed position, whereby in said first mode a key ring engaged in said gap by said member is positively locked therein by said member, and in said second mode a key ring engaged in said gap is non-positively retained therein to permit free use of the pen held by said member with a ring either retained on said projection or snapped off through said channel free of said projection.

2. The device of claim 1 wherein said body is a flat elongated tray which progressively flares from a fourth side to achieve its widest proportion at its second side, said projection comprising an arm-like structure integral with said second side which traverses the length of said widest proportion leaving a gap between said tray and said arm-like structure, and further defining a restriction of said gap at the distal end of said arm-like structure.

3. The structure of claim 2 wherein the distal end of said arm-like structure contains a mortise dimensioned to receive the end of said pen tip.

4. The device of claim 2 wherein said arm-like structure is narrowed adjacent its juncture with said second side to promote the flexibility thereof and permit the lateral deflection of said projection to permit the widening of said channel to pass a key or keyring therethrough by deflecting said arm-like structure from said body.

* * * * *